US007506571B2

(12) United States Patent
Breytenbach et al.

(10) Patent No.: US 7,506,571 B2
(45) Date of Patent: Mar. 24, 2009

(54) BREECH ASSEMBLY FOR AN ELECTROTHERMAL GUN

(75) Inventors: Frederik Gert Johannes Breytenbach, Bronkhorstspruit (ZA); Ernst Johann Heinrich Müller, Pretoria (ZA)

(73) Assignee: Denel (PTY) Ltd., Pretoria (ZA)

( * ) Notice: Subject to any disclaimer, the term of this patent is extended or adjusted under 35 U.S.C. 154(b) by 580 days.

(21) Appl. No.: 10/503,472

(22) PCT Filed: Feb. 20, 2003

(86) PCT No.: PCT/ZA03/00027

§ 371 (c)(1),
(2), (4) Date: Jun. 6, 2005

(87) PCT Pub. No.: WO03/071218

PCT Pub. Date: Aug. 28, 2003

(65) Prior Publication Data

US 2006/0048636 A1 Mar. 9, 2006

(30) Foreign Application Priority Data

Feb. 25, 2002 (ZA) ..... 2002/1546

(51) Int. Cl.
*F41F 1/00* (2006.01)

(52) U.S. Cl. ..... 89/8; 89/23; 89/26; 102/202

(58) Field of Classification Search ..... 89/23, 89/26, 8; 102/202
See application file for complete search history.

(56) References Cited

U.S. PATENT DOCUMENTS

| | | | | | |
|---|---|---|---|---|---|
| 2,800,057 | A * | 7/1957 | Hoopes | 89/28.05 |
| 4,308,785 | A * | 1/1982 | Samuel | 89/4.2 |
| 4,548,121 | A | 10/1985 | Janssen et al. | |
| 4,957,035 | A | 9/1990 | Eskam et al. | |
| 5,171,932 | A | 12/1992 | McElroy | |
| 5,544,588 | A * | 8/1996 | Boggavarapu et al. | 102/472 |
| 5,663,519 | A | 9/1997 | Muller | |
| 5,898,124 | A * | 4/1999 | Krumm et al. | 102/430 |
| 5,988,070 | A * | 11/1999 | Krumm et al. | 102/430 |
| 6,223,643 | B1 | 5/2001 | Muller | |
| 7,059,249 | B2 * | 6/2006 | Chaboki et al. | 102/202.8 |
| 2006/0096485 | A1 * | 5/2006 | Stark et al. | 102/202 |

* cited by examiner

*Primary Examiner*—J. Woodrow Eldred
*Assistant Examiner*—Gabriel J Klein
(74) *Attorney, Agent, or Firm*—Nixon & Vanderhye P.C.

(57) ABSTRACT

This invention relates to a breech assembly of a gun adapted to fire caseless charges, ignited and enhanced with electrothermal chemical (ETC) charges. The gun utilizes charges as propellant and a plasma generator cartridge (PGC) for generating plasma when an electrical current is applied thereto. The breech assembly comprises a breech ring, a tilting block assembly, with a spindle installed and a sliding block for supporting or locking the tilting block assembly in a sealed position. The tilting block assembly is movable between a PGC firing orientation and a PGC loading/removal orientation. The breech assembly further includes a crank means, which includes a guide means for rotating the tilting block assembly from the PGC firing orientation to the PGC loading/removal orientation.

11 Claims, 5 Drawing Sheets

BREECH ASSEMBLY FOR AN ELECTROTHERMAL GUN

This application is the US national phase of international application PCT/ZA03/00027, filed 20 Feb. 2003, which designated the US and claims priority to ZA Application No. 2002/1546 filed 25 Feb. 2002. The entire contents of these applications are incorporated herein by reference.

INTRODUCTION AND BACKGROUND TO THE INVENTION

This invention relates to a breech assembly for an electrothermal gun, a gun provided with such a breech assembly and an obturation assembly for a gun.

A conventional tilting block assembly for a gun such as a cannon or the like, comprises a spindle having a shaft and a mushroom shaped head; and an obturation set including a resilient obturator pad for mating with and sealing against an obturation seat, an inner ring and two retaining rings. The obturation seat is usually defined by the rim of the mouth of a barrel at the rear end of the firing chamber. When the spindle is displaced axially relative to the barrel by the combustion of a propellant charge in the firing chamber, the obturator pad deforms radially outwardly into sealing engagement with the obturation seat, with the retaining rings limiting deformation of the obturator pad and preventing extrusion of the obturator pad.

The tilting block assembly is usually held in position by a crank arm and rollers, which are supported by the breech ring of the gun and the shaft of the spindle usually extends through a hole in the tilting block assembly abutting a sliding block. Although this application is for the loading and firing of a front loaded plasma generator cartridge (PGC), it is also possible to machine a chamber in the rear end of the spindle for a cased primer for igniting the propellant charge, and a so called primer head space is defined between the rear end of a primer case and the front face of the sliding block.

It is known to use a plasma generator cartridge (PGC) to generate plasma when high-voltage is applied thereto. Various examples of PGC's and/or electrothermal chemical (ETC) applications are disclosed in the following U.S. Pat. Nos. 4,640,180 4,895,062 5,042,359 5,171,932 5,183,956 5,612,506 5,675,115 5,898,124 5,945,623 5,988,070.

A common disadvantage of all the above arrangements is that the PGC is loaded from the rear into a carrier mechanism, such as a stub case or spindle arrangement, causing sealing problems between the PGC and the carrier mechanism. Another disadvantage is that the rear inserted PGC increases the time required for loading the PGC and charge during sustained and rapid fire. The use of cases for the main obturation and PGC carrier, further increases the overall operational cost per fired shot. Further disadvantages of the known systems are that the PGC's and stub cases are strewn around the inside the turret of the gun and that the sealing efficiencies of the known obturation assemblies are not reliable.

OBJECT OF THE INVENTION

It is an object of the present invention to provide a breech assembly for an electrothermal gun, a gun provided with such a breech assembly and an obturation assembly for a gun with which the aforesaid disadvantages can be overcome or at least minimised.

SUMMARY OF THE INVENTION

According to a first aspect of the invention there is provided a gun comprising a breech assembly adapted to receive a caseless charge and a plasma generator cartridge (PGC).

According to a second aspect of the invention there is provided a breech assembly adapted to fire a caseless charge with the aid of a plasma generator cartridge (PGC), the breech assembly comprising a tilting block assembly having a sealing side and an opposite rear side, the sealing side being adapted to receive an obturation set and a spindle head which is adapted to receive a PGC for generating plasma.

Further according to the invention, the tilting block assembly may be movable between a sealed position and an open position.

The breech assembly may further include a sliding block and a breech ring for retaining the tilting block assembly in the sealed and open positions.

The tilting block assembly may further be movable between a PGC firing orientation and a PGC loading/removal orientation.

The tilting block assembly spindle head may be adapted to receive the PGC from the side of the sealing face when in the open position and the PGC loading/removal orientation.

The breech assembly may further include a crank means for rotating the tilting block assembly from the PGC firing orientation to the PGC loading/removal orientation when the tilting block moves from the sealed position to the open position.

The tilting block assembly may be pivotally mounted on the crank means, relative to the breech assembly, for rotation about a first axis of rotation, from the sealed position to the open position.

The crank means may further include a guide means for guiding rotation of the tilting block assembly form the PGC firing orientation to the PGC loading/removal orientation, when the tilting block assembly moves from the sealed position to the open position.

The tilting block assembly may further be pivotally mounted on the crank means for rotation about a second axis between the PGC firing orientation and the PGC loading/removal orientation.

The crank means may include a crank arm of which a first end may be pivotally connected to the breech ring by a spline shaft and a second end of which may be pivotally connected to the tilting block assembly by a stub shaft.

The guide means may be in the form of a tilting block assembly first roller running in a first guide slot. Preferably the tilting block assembly first roller is disposed on the tilting block assembly and the first guide slot defined by the breech ring.

A tilting block assembly second roller may run in a second elongated guide slot. The second slot may be defined by the breech ring.

The stub shaft may further vary in position in a slot in the crank arm.

The sliding block may be slidably movable between a closed position wherein the tilting block assembly is retained in the firing orientation and a displaced position wherein the tilting block assembly is free to pivot to a loading/removal orientation.

According to a third aspect of the invention there is provided an obturation assembly for a gun of the type comprising a barrel of which a rear end defines a firing chamber having an obturation seat and the gun further having a breech ring; and a tilting block assembly which is movable between a sealed position and an open position, the obturation assembly comprising:

an obturation set including an annular obturator pad for sealing against the obturation seat when in the sealed position;

an obturation spindle having a shaft and a head, the shaft extending coaxially through the obturator pad; and PGC receiving means provided in the head.

BRIEF DESCRIPTION OF THE DRAWINGS

The invention will now be described further by way of example only with reference to the accompanying drawings wherein.

DESCRIPTION OF A PREFERRED EMBODIMENT OF THE INVENTION

Figure 1:
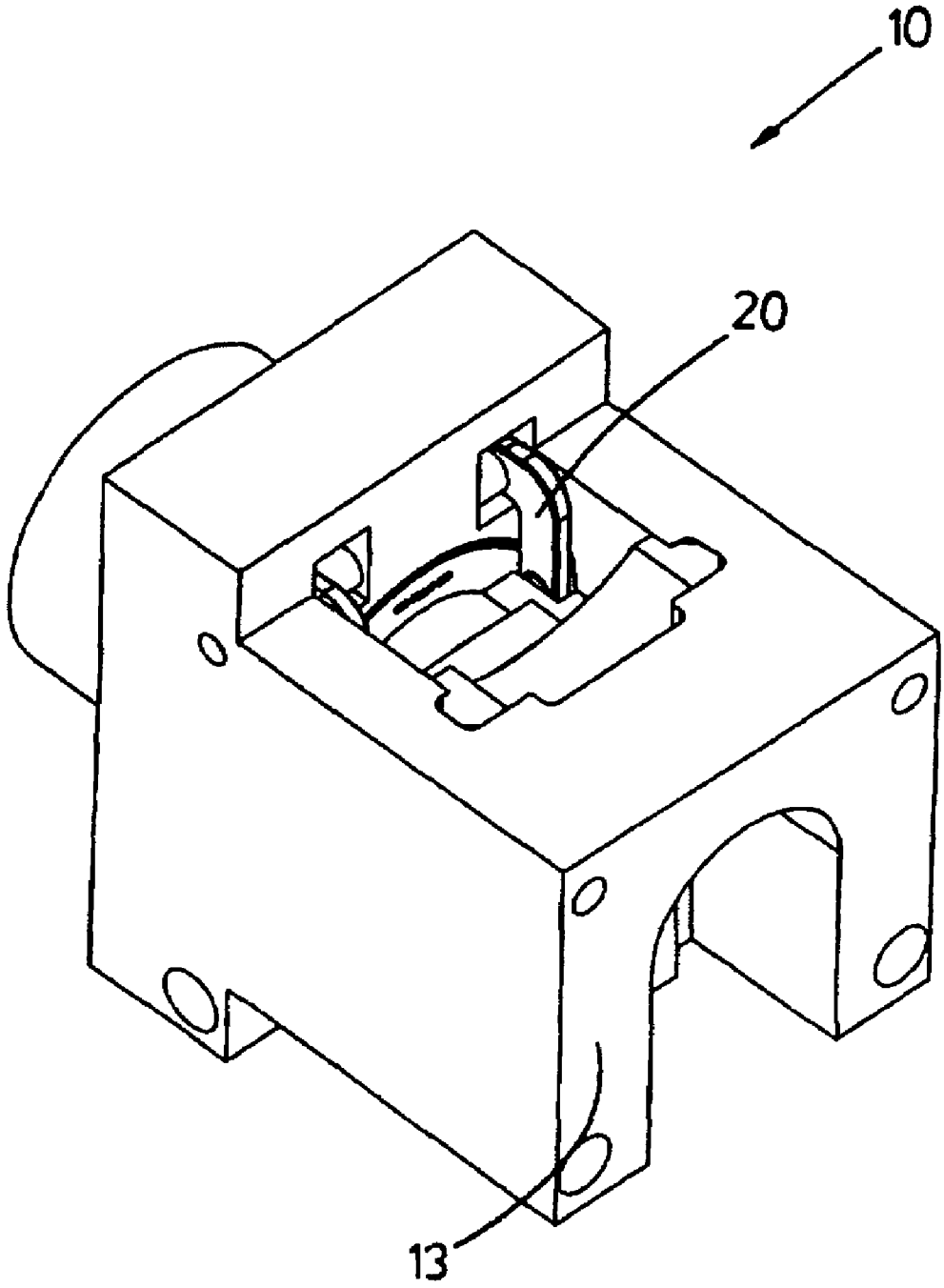
FIG. 1 is a perspective view of a breech assembly according to a preferred embodiment of the invention, with a tilting block assembly in a sealed position.

Referring to the drawings, a breech assembly of a gun (not shown) adapted to fire caseless charges, ignited and enhanced with electrothermal chemical (ETC) charges, is generally designated by reference numeral 10.

The gun utilises charges as propellant and a plasma generator cartridge (PGC) 17 for generating plasma when an electrical current is applied thereto.

Figure 4:
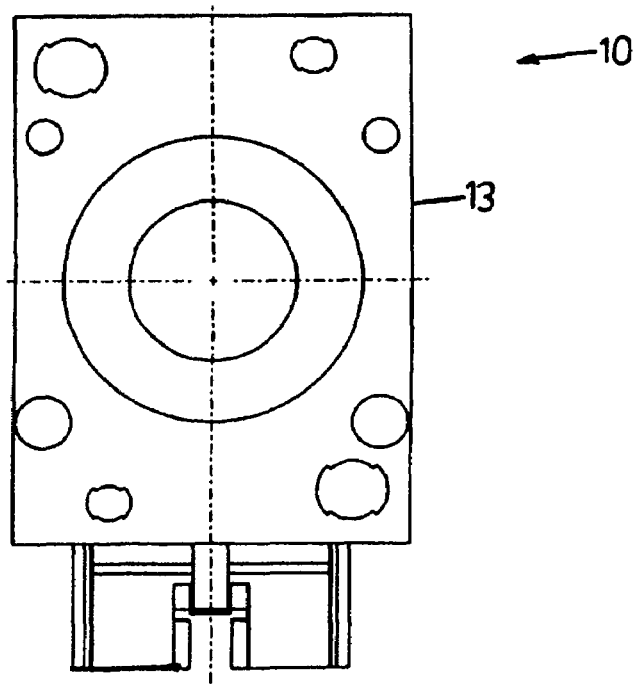
FIG. 4 is a front end view of FIG. 2.
Figure 5:
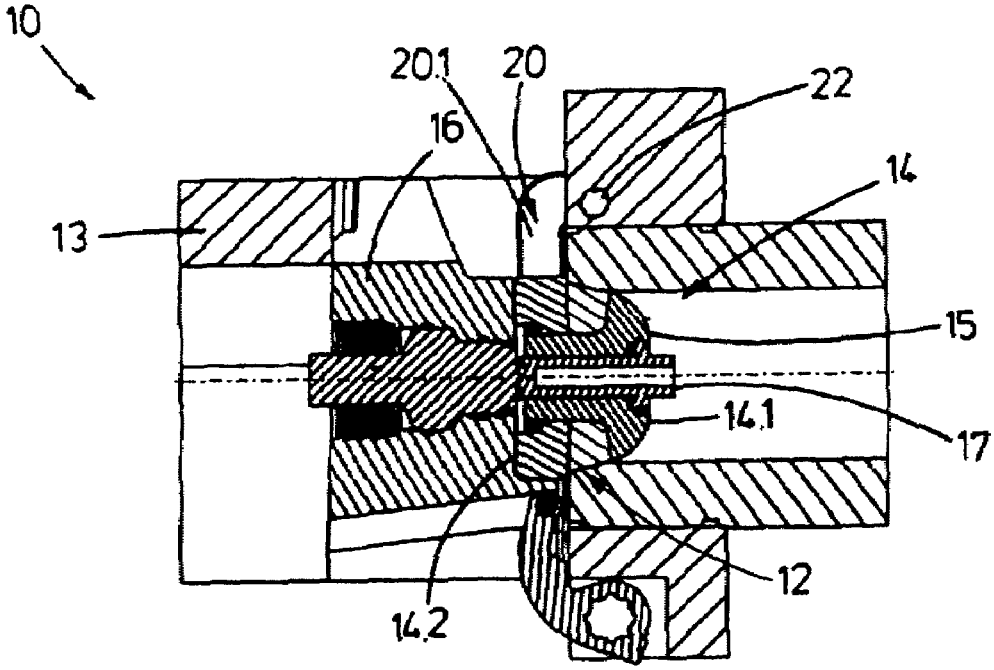
FIG. 5 is a cross-sectional side view along line A-A$^1$ in FIG. 3.
Figure 6:
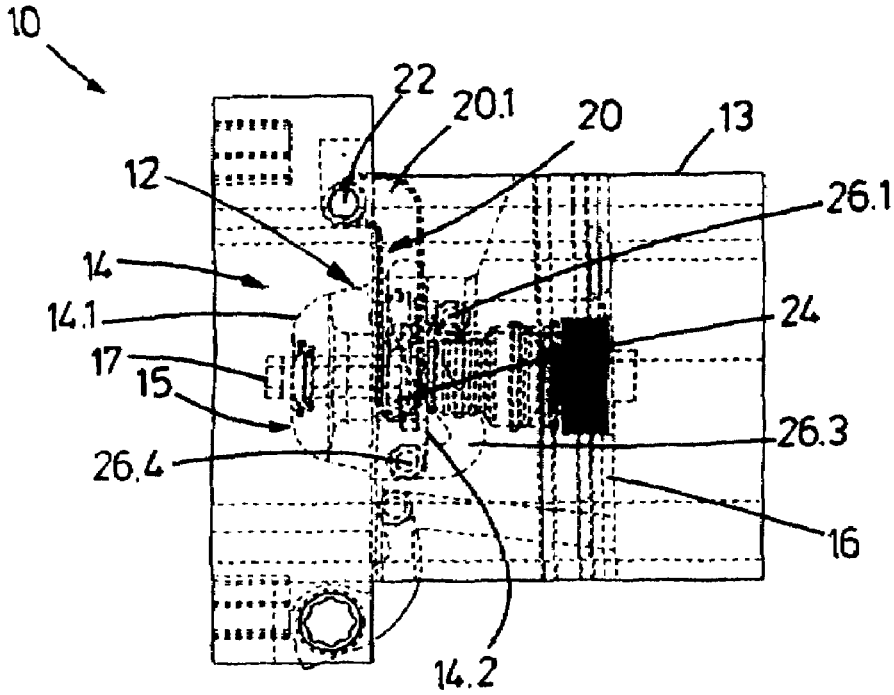
FIG. 6 is diagrammatical side view of FIG. 1.

Referring to FIG. 5, the breech assembly 10 comprises a breech ring 13, a tilting block assembly 14, with a spindle 15 installed, having a sealing side 14.1 and an opposite rear side 14.2. The sealing side 14.1 is the mating side for an obturation set 12 and the spindle 15, of which a head of the spindle is adapted to load the PGC 17. The tilting block assembly 14 is movable between a sealed position shown in FIGS. 1, 3, 5 and 6, and an open position shown in FIGS. 2, 4, and 7.

The breech assembly 10 further includes a sliding block 16 for supporting or locking the tilting block assembly 14 in the sealed position.

Figure 2:
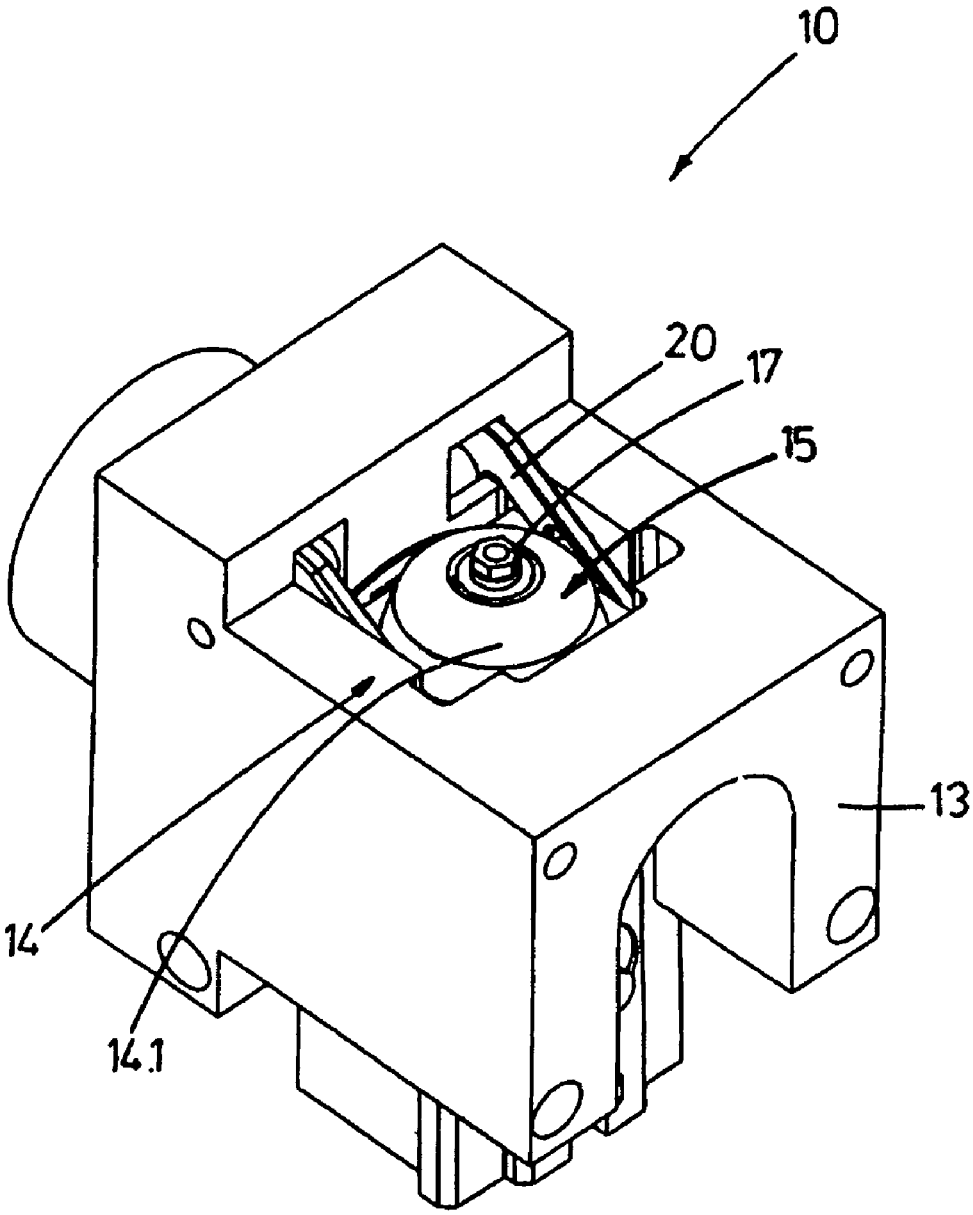
FIG. 2 is the same view as that of FIG. 1 with the tilting block assembly in an open position.
Figure 3:
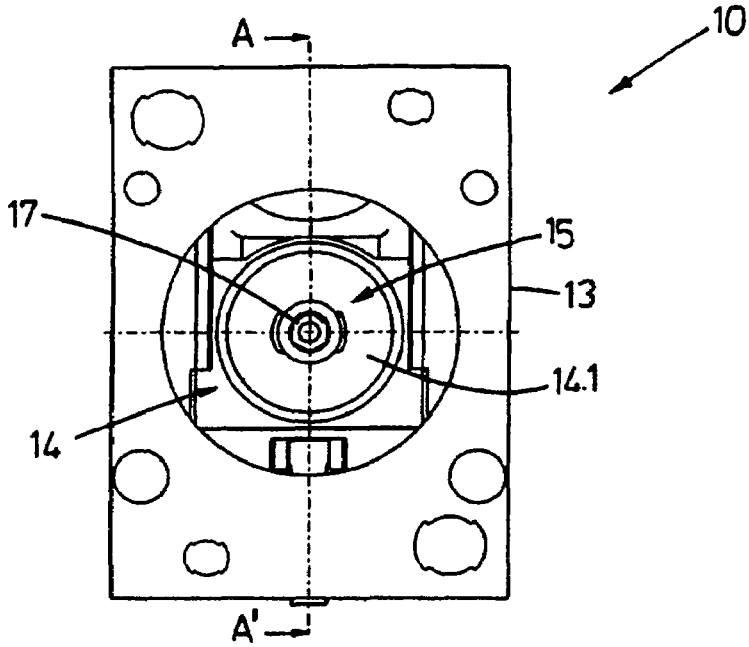
FIG. 3 is a front end view of FIG. 1.
Figure 7:
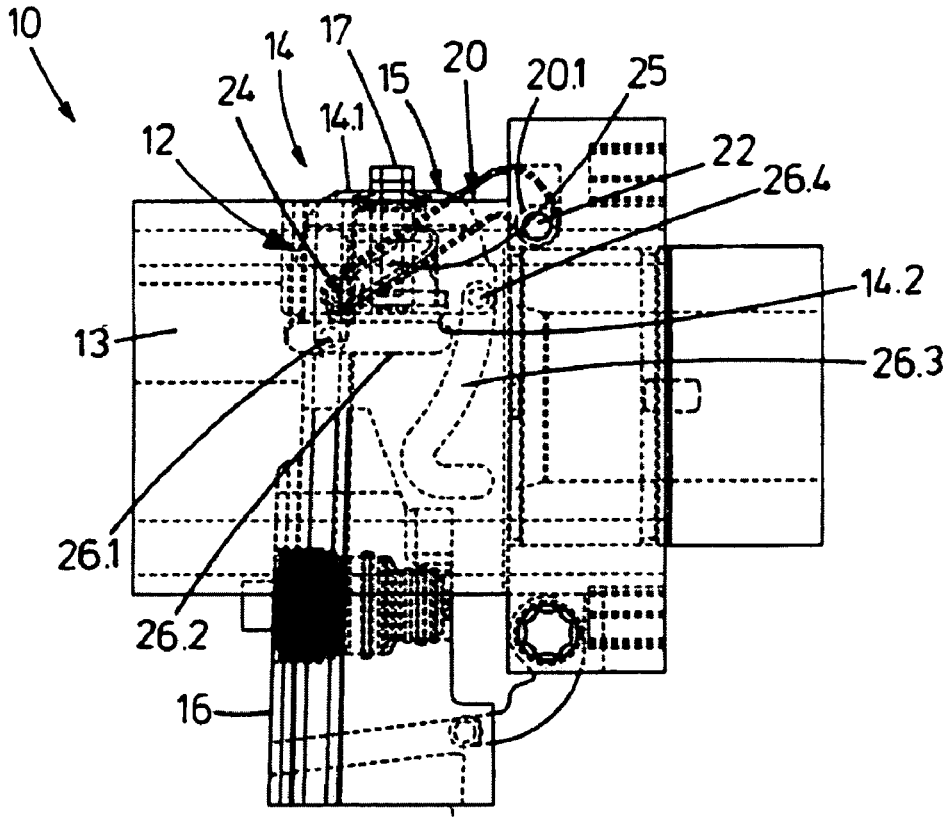
FIG. 7 is a diagrammatical side view of FIG. 2.

The tilting block assembly 14 is further movable between a PGC firing orientation shown in FIGS. 1, 3, 5 and 6, and a PGC loading/removal orientation shown in FIGS. 2, 4, and 7. The spindle head is adapted to load the PGC 17 when in the loading/removal orientation.

The breech assembly 10 further includes a crank means for rotating the tilting block assembly 14 from the PGC firing orientation to the PGC loading/removal orientation when moving from the sealed position to the open position.

The crank means includes a crank arm 20 of which a first end 20.1 is pivotally connected to the breech ring 13 by a spline shaft 22 and a second end 20.2, which is pivotally connected to the tilting block assembly 14 by a stub shaft 24. The stub shaft 24 varies in position in a slot 25 in the crank arm 20.

Figure 8:
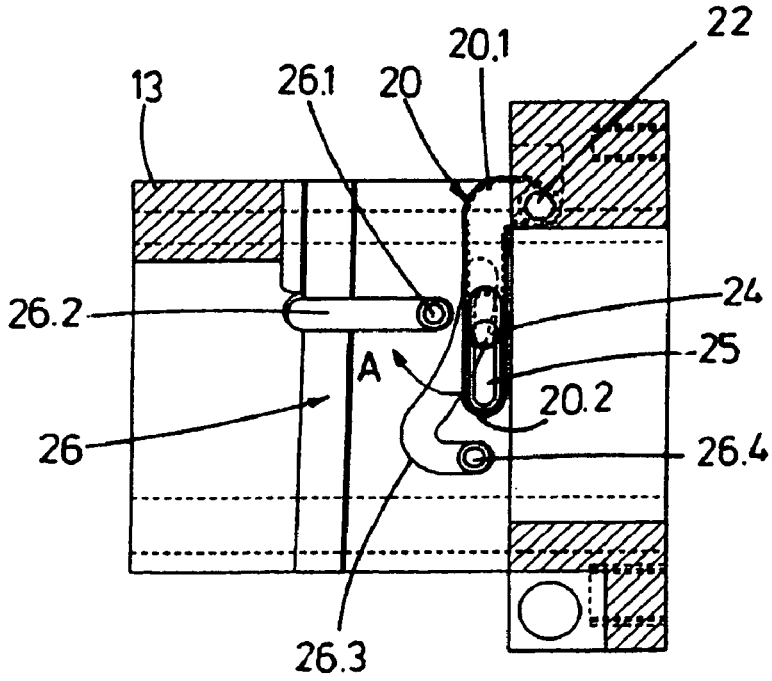
FIG. 8 is a diagrammatical cross-sectional side view similar to FIG. 5 with some parts removed.

Referring particularly to FIG. 8, the crank means further includes a guide means generally designated by reference numeral 26 for guiding rotation of the tilting block assembly 14 form the PGC firing orientation to the PGC loading/removal orientation, when the tilting block assembly 14 moves between the sealed and the open positions.

The guide means 26 is in the form a tilting block assembly second roller 26.1 disposed on the tilting block assembly 14 and running in a second guide slot 26.2 defined by the breech ring 13.

The guide means 26 is further in the form of a tilting block assembly first roller 26.4 disposed on the tilting block assembly 14, for running in an elongated L-shaped first guide slot 26.3 defined by the breech ring 13.

The sliding block 16 is slidably movable between a closed position wherein the tilting block assembly 14 is retained in the firing position, and a displaced position wherein the tilting block assembly 14 is free to pivot to the open position.

The tilting block assembly 14 houses a spindle 15, defining a spindle head. The head is disposed on the sealing side 14.1 of the tilting block assembly and defines a PGC loading formation in which the PGC 17 is disposed.

In use, the sliding block 16 is moved from the closed position to the displaced position. The crank arm 20 is pivotally movable as indicated by arrow A in FIG. 8, about the spline shaft 22, to move the tilting block assembly 14 from the sealed position to the open position. While so moving, the tilting block assembly 14 is pivoted by the guide means 26 from the PGC firing orientation to the PGC loading/removal orientation, in that the tilting block assembly second roller 26.1 and tilting block assembly first roller 26.4 follow the slots 26.2 and 26.3 respectively.

In the PGC loading orientation, a PGC 17 is located in the PGC loading formation. A charge (not shown) is loaded into the barrel chamber of the gun. Subsequently, the procedure is reversed by pivoting the crank arm 20 about the spline shaft 22 to move the tilting block assembly 14 to the sealed position. In the process, the tilting block assembly is pivoted from the loading orientation to the firing orientation, by the guide means 26. The sliding block 16 is moved to the closed position. The gun is now ready to be fired. When the tilting block assembly 14 is moved back to the PGC removal orientation after the gun has been fired, the fired PGC 17 is obviously removed first before the next one is loaded in the PGC loading formation.

The applicant has found that the breech assembly 10 according to the invention is highly efficient and saves operational time and costs. The applicant has further found that superior obturation is obtained with a tilting block assembly 14 and an obturation assembly, according to the invention in that there is a positively sealed passage defined between the front and rear ends of the spindle, containing the loaded PGC 17.

It will be appreciated that variations in detail are possible with a breech assembly for an electrothermal gun, a gun provided with such a breech assembly and an obturation assembly for a gun without departing from the scope of the appended claims.

The invention claimed is:

1. A gun comprising a breech assembly adapted to receive a caseless charge and a plasma generator cartridge (PGC), and to fire the caseless charge with the aid of the PGC, the breech assembly comprising: a tilting block assembly movable between a sealed position and an open position, and having a sealing side and an opposite rear side, the sealing side being adapted to receive an obturation set and a spindle head which is adapted to receive a PGC for generating plasma, a sliding block and a breech ring for retaining the tilting block assembly in the sealed and open positions, the tilting block assembly being further movable between a PGC firing orientation and a PGC loading/removal orientation, and a crank means for rotating the tilting block assembly from the PGC firing orientation to the PGC loading/removal orientation when the tilting block moves from the sealed position to the open position, wherein the tilting block assembly is pivotally mounted on the crank means, relative to the breech assembly, for rotation about a first axis of rotation, from the sealed position to the open position, and wherein the crank means is pivotally mounted on the breech ring.

2. The breech assembly according to claim 1 wherein the sliding block is slidably movable between a closed position wherein the tilting block assembly is retained in the firing orientation and a displaced position wherein the tilting block assembly is free to pivot to a loading/removal orientation.

3. The breech assembly according to claim 2 wherein the tilting block assembly spindle head is adapted to receive the PGC from the side of the sealing face when in the open position and the PGC loading/removal orientation.

4. The breech assembly according to claim 1 wherein the crank means includes a guide means for guiding rotation of the tilting block assembly from the PGC firing orientation to the PGC loading/removal orientation, when the tilting block assembly moves from the sealed position to the open position.

5. The breech assembly according to claim 4 wherein the tilting block assembly is pivotally mounted on the crank means for rotation about a second axis between the PGC firing orientation and the PGC loading/removal orientation.

6. The breech assembly according to claim 5 wherein the guide means is in the form of a tilting block assembly first roller running in a first guide slot.

7. The breech assembly according to claim 6 wherein the tilting block assembly first roller is disposed on the tilting block assembly and the first guide slot is defined by the breech ring.

8. The breech assembly according to claim 7 wherein a tilting block assembly second roller runs in a second elongated guide slot.

9. The breech assembly according to claim 8 wherein the second guide slot is defined by the breech ring.

10. The breech assembly according to claim 1 wherein the crank means includes a crank arm of which a first end is pivotally connected to the breech ring by a spline shaft and a second end of which is pivotally connected to the tilting block assembly by a stub shaft.

11. The breech assembly according to claim 10 wherein the stub shaft varies in position in a slot in the crank arm.

* * * * *